US008369062B2

(12) United States Patent
Fisher et al.

(10) Patent No.: US 8,369,062 B2
(45) Date of Patent: Feb. 5, 2013

(54) DETONATION CONTROL SYSTEM

(75) Inventors: Delmer D. Fisher, Idianapolis, IN (US); Brady A. Plummer, Fishers, IN (US); Robert W. Plummer, McCordsville, IN (US)

(73) Assignee: Raytheon Company, Waltham, MA (US)

( * ) Notice: Subject to any disclaimer, the term of this patent is extended or adjusted under 35 U.S.C. 154(b) by 152 days.

(21) Appl. No.: 12/874,878

(22) Filed: Sep. 2, 2010

(65) Prior Publication Data

US 2011/0056400 A1 Mar. 10, 2011

Related U.S. Application Data

(60) Provisional application No. 61/240,005, filed on Sep. 4, 2009.

(51) Int. Cl.
*F23Q 7/00* (2006.01)

(52) U.S. Cl. ..... 361/249; 361/250

(58) Field of Classification Search ..... 361/249, 361/250; 102/205, 217
See application file for complete search history.

(56) References Cited

U.S. PATENT DOCUMENTS

| | | | | |
|---|---|---|---|---|
| 2,616,000 | A | 10/1952 | Beautense | 200/38 |
| 3,959,670 | A | 5/1976 | Heckelman | 307/268 |
| 4,674,047 | A * | 6/1987 | Tyler et al. | 89/28.05 |
| 5,189,246 | A * | 2/1993 | Marsh et al. | 102/217 |
| 2007/0125256 | A1 | 6/2007 | Frickey et al. | 102/205 |
| 2009/0235838 | A1 | 9/2009 | Hultman | 102/335 |
| 2010/0031841 | A1 | 2/2010 | Michel et al. | 102/222 |
| 2010/0132576 | A1 | 6/2010 | Koekemoer et al. | 102/215 |
| 2010/0170411 | A1 | 7/2010 | Ballantine et al. | 102/206 |
| 2010/0180786 | A1 | 7/2010 | Goodridge et al. | 102/201 |

FOREIGN PATENT DOCUMENTS

| | | |
|---|---|---|
| FR | 2 530 333 | 7/1982 |
| WO | WO 2009/097036 A2 | 11/2008 |

OTHER PUBLICATIONS

PCT Notification of Transmittal of the International Search Report and the Written Opinion of the International Searching Authority, or the Declaration with attached PCT International Search Report and Written Opinion of the International Searching Authority in International Application No. PCT/US2010/047843, International Filing date: Oct. 9, 2010; 12 pages, date of mailing Jun. 30, 2011.

* cited by examiner

*Primary Examiner* — Danny Nguyen
(74) *Attorney, Agent, or Firm* — Renner, Otto, Boisselle & Sklar, LLP

(57) ABSTRACT

According to certain embodiments, a detonation control system includes a controller circuit coupled to a manual switch and a detonation device. The detonation device is configured to activate an explosive. The controller circuit includes a memory operable to store one of a multiple time-to-fire settings representing a time delay from arming the detonation device to activation of the detonation device. The controller circuit is operable to store a first time-to-fire setting in the memory, store another of the multiple time-to-fire settings in the memory upon actuation of the manual switch, and repeat the step of storing another of the multiple time-to-fire settings in the memory for each actuation of the manual switch.

25 Claims, 2 Drawing Sheets

DETONATION CONTROL SYSTEM

RELATED APPLICATIONS

This application claims the benefit under 35 U.S.C. §119 (e) of the priority of U.S. Provisional Patent Application Ser. No. 61/240,005, entitled "Detonation Control Device," filed Sep. 4, 2009, the entire disclosure of which is hereby incorporated by reference.

TECHNICAL FIELD OF THE DISCLOSURE

This disclosure generally relates to detonation devices, and more particularly, to a detonation control system.

BACKGROUND

Explosives, such as those used in military combat, may be initiated by detonation devices. Detonation devices include various devices that convert a signal into mechanical energy that activates the explosive's main charge. Examples of detonation devices includes blasting caps, exploding foil initiators (EFIs) that convert electrical signals into mechanical energy, and shock tubes that convert pneumatic pressure pulses into mechanical energy.

SUMMARY

According to certain embodiments, a detonation control system includes a controller circuit coupled to a manual switch and a detonation device. The detonation device is configured to activate an explosive. The controller circuit includes a memory operable to store one of a multiple time-to-fire settings representing a time delay from arming the detonation device to activation of the detonation device. The controller circuit is operable to store a first time-to-fire setting in the memory, store another of the multiple time-to-fire settings in the memory upon actuation of the manual switch, and repeat the step of storing another of the multiple time-to-fire settings in the memory for each actuation of the manual switch.

Certain embodiments of the present disclosure may provide one or more technical advantages. For example, certain embodiments may provide a relatively low-cost, easy-to-use system for modifying time-to-fire setting values of a detonation control system. Detonation control devices are typically designed as single-use devices in that they are usually destroyed when the detonation device and its associated explosive are activated. It would therefore be beneficial for the detonation control system to be formed of relatively few, low-cost components to limit its cost and/or complexity. Certain embodiments of the detonation control system of the present disclosure use a particular sequence of manual switch movements to select a time-to-fire setting value using elements that are also used for other functionality typically provided by the detonation control system. Thus, the incremental costs associated with additional program code to implement the modifiable time-to-fire setting value may be relatively negligible compared to other time-to-fire setting techniques using manually settable switches.

Some embodiments may benefit from some, none, or all of these advantages. Other technical advantages may be readily ascertained by one of ordinary skill in the art.

DESCRIPTION OF THE DRAWINGS

To provide a more complete understanding of embodiments of the present disclosure and the features and advantages thereof, reference is made to the following description taken in conjunction with the accompanying drawings, in which.

DETAILED DESCRIPTION OF EXAMPLE EMBODIMENTS

Figure 1:
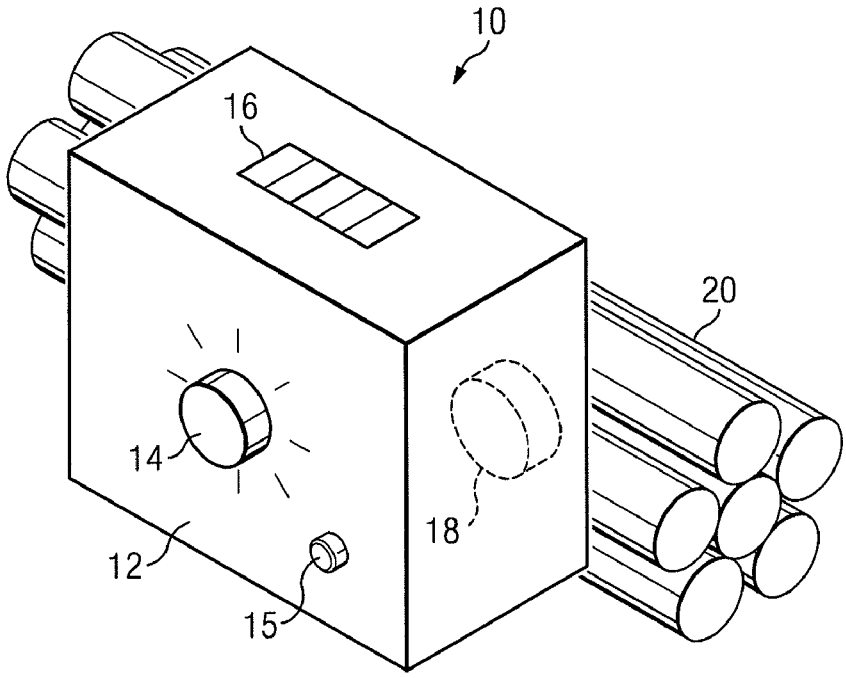
FIG. 1 illustrates an example detonation control system according to certain embodiments of the present disclosure.

FIG. 1 illustrates an example detonation control system 10 according to certain embodiments of the present disclosure. Detonation control system 10 includes a housing 12 on which a manual switch 14, an interlock tab 15, an indicator light 16, and a detonation device 18 may be configured. Housing 12 is adapted to be secured adjacent to an explosive 20 that explodes upon activation by detonation device 18. As will be described in detail below, detonation control system 10 may include a controller circuit (described in greater detail with reference to FIG. 2) that stores one of multiple time-to-fire settings that each represents a delay time for activation of detonation device 18.

Detonation device 18 may be of any type that is configured to activate a desired explosive 20. For certain embodiments in which explosive 20 is activated by a relatively small shock wave or explosion, detonation device 18 may include a relatively small explosive charge that detonates upon an electrical signal to generate a relatively small explosion that activates explosive 20. As an example, detonation device 18 may be an exploding foil initiator (EFI) that includes small pieces of aluminum foil.

Explosive 20 includes any suitable type of explosive material that may be activated by detonation device 18. Examples of such materials comprising explosive 20 may include composition C4, tetrytol, nitro-glycerin, and/or Trinitrotoluene.

Manual switch 14 receives user input for controlling operation of detonation control system 10. In the particular embodiment shown, manual switch 14 comprises a multi-position rotary switch that is mechanically operated to generate certain signals according to its switch position. In certain embodiments, manual switch 14 may include any suitable user input mechanism, such as one or more momentary switches that may be alternatively and/or simultaneously actuated for controlling the operation of detonation control system 10.

Manual switch 14 may also be used for other functions provided by detonation control system 10. That is, manual switch 14 may be used to provide other functionality for detonation control system 10, such as arming detonation control system 10 and/or placing detonation control system 10 in a safe mode in which detonation control system 10 is inhibited from activating explosive 20.

Indicator light 16 provides a visual indication of the current time-to-fire setting 22 (described below with reference to FIG. 2) of detonation control system 10. However, indication of the current time-to-fire setting 22 may be provided in any suitable manner. For example, detonation control system 10 may include a speaker or other sound generating device that provides an audible indication of the current time-to-fire setting 22.

In certain embodiments, indicator light 16 comprises a bar graph type display including a plurality of light emitting diodes (LEDs), one for each available time-to-fire setting 22 value. Thus, for certain embodiments in which detonation control system 10 comprises five selectable time-to-fire setting 22 values, indicator light 16 may have five LEDs, corresponding to the five selectable time-to-fire setting 22 values.

Various detonation control systems that are used to initiate explosives 20 have been developed. In many cases, these detonation control systems are single use in that they are typically destroyed when explosive 20 is initiated. Embodiments of the disclosure provide a relatively low-cost and easy to use detonation control system.

Certain embodiments of the present disclosure may provide one or more technical advantages. For example, certain embodiments may provide a relatively low-cost, easy-to-use system for modifying time-to-fire setting 22 values of the detonation control system 10. Detonation control devices, such as detonation control system 10, are typically designed as single-use devices in that they are usually destroyed when detonation device 18 and its associated explosive 20 are initiated. It would therefore be beneficial for detonation control system 10 to be formed of relatively few, low-cost components to limit its cost and/or complexity. Certain embodiments of detonation control system 10 use a particular sequence of manual switch 14 movements to select from among one of multiple time-to-fire setting 22 values using elements that are also used for other functionality typically provided by detonation control system 10. Thus, the incremental costs associated with additional program code to implement the modifiable time-to-fire setting 22 value may be relatively negligible compared to other time-to-fire setting techniques using manually settable switches.

Figure 2:
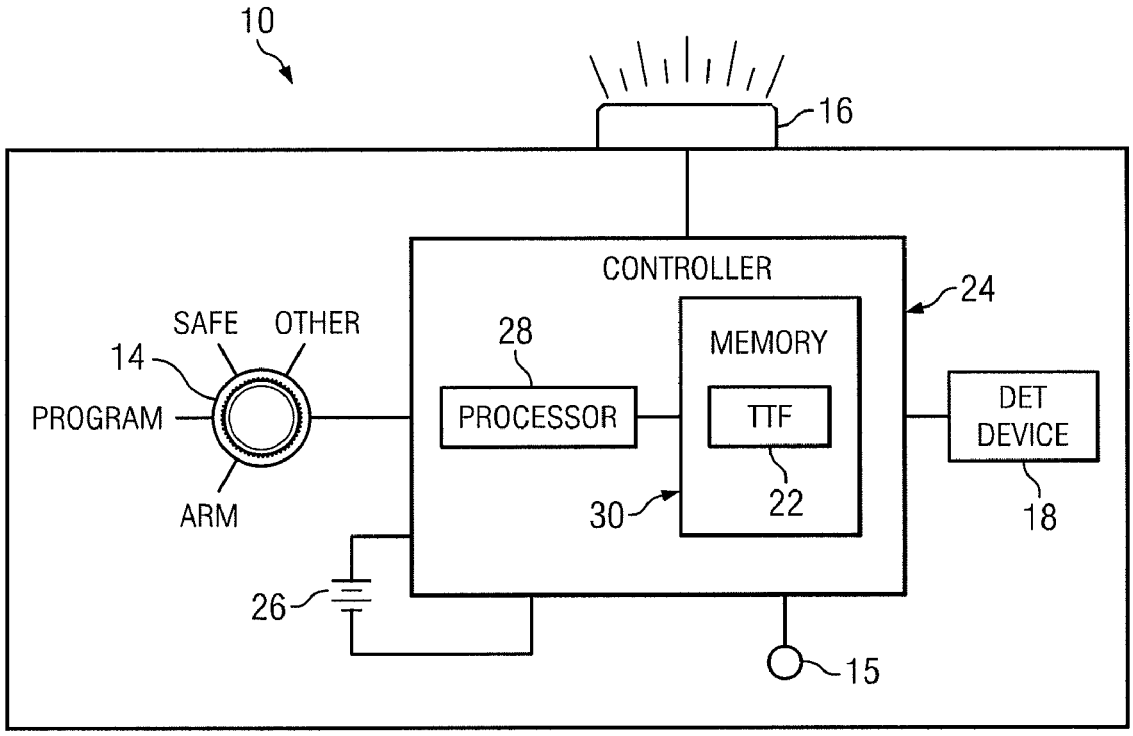
FIG. 2 illustrates several elements of the example detonation control system 10 of FIG. 1.

FIG. 2 illustrates several elements of the example detonation control system 10 of FIG. 1. Detonation control system 10 includes a controller 24 coupled to detonation device 18, a battery 26, indicator light 16, and manual switch 14, and interlock tab 15. Battery 26 provides electrical power for operation of detonation control system 10. However, detonation control system 10 may be powered in any suitable manner. In this particular embodiment in which manual switch is a multi-position rotary switch, manual switch 14 is movable between a safe position, a program position, an arm position, and any other suitable positions. Controller 24 comprises a processor 28 and a memory unit 30 that stores a time-to-fire setting 22 that may be adjusted according to cyclic movements of switch 14.

Time-to-fire setting 22 is a value generally representing an elapsed delay time from when manual switch 14 is moved to the arm position to activation of detonation device 18. For example, if time-to-fire setting 22 is set to two minutes, detonation device 18 will be activated two minutes after manual switch 14 is moved to the arm position. In certain embodiments, controller 24 may alternatively store one of multiple differing values in time-to-fire setting 22. In certain embodiments, five time-to-fire setting 22 values ranging from two minutes to ten minutes may be alternatively stored in time-to-fire setting 22. Thus, elapsed delay times of two minutes, four minutes, six minutes, eight minutes, and ten minutes may be alternatively stored in time-to-fire setting 22 using cyclic movements of manual switch 14. These values are provided for example purposes only.

In certain embodiments, values stored in time-to-fire setting 22 may be selected manually using a specified timed sequence of movement of manual switch 14 between differing positions. For the particular embodiment shown, the elapsed delay time value stored in time-to-fire setting 22 may be modified by a cyclic movement of manual switch 14 from the program position to the safe position and back to the program position during a time period that is less than a specified threshold. In certain embodiments, the specified threshold is less than 10 seconds.

Controller 24 may be implemented in any suitable combination of hardware, firmware, and software. Controller 24 includes one or more processors 28 and one or more memory units 30. A processor as described herein may include one or more microprocessors, controllers, or any other suitable computing devices or resources and may work, either alone or with other components of detonation control system 10, to provide a portion or all of the functionality of detonation control system 10 described herein. A memory unit 30 as described herein may take the form of volatile and/or non-volatile memory including, without limitation, magnetic media, optical media, random access memory (RAM), read-only memory (ROM), removable media, or any other suitable memory component. A portion or all of memory units 30 may be remote from controller 24, if appropriate.

Embodiments of controller 24 may include logic contained within a medium. Logic may include hardware, software, and/or other logic. The medium in which the logic is encoded may include a tangible medium. For example, controller 24 may comprise a programmable logic device, such as an application specific integrated circuit (ASIC), or a field programmable gate array (FPGA). The logic may perform operations when executed by processor 28. Certain logic may include a computer program, software, computer executable instructions, and/or instructions capable being executed by controller 24. The logic may also be embedded within any other suitable medium without departing from the scope of the disclosure.

The components of controller 24 may be implemented using any suitable combination of software, firmware, and hardware. For example, controller 24 may include a computing device, such as a personal computer, a workstation, a network computer, a kiosk, a wireless data port, a personal data assistant (PDA), or other computing device having at least one switch 14 for receiving user input, an indicator light 16 for indicating the value stored in time-to-fire setting 22, and an output for actuating detonating device 18.

Modifications, additions, or omissions may be made to detonation control system 10 without departing from the scope of the disclosure. The components of detonation control system 10 may be integrated or separated. For example, processor 28 may execute instructions stored in a memory 24 that is internal to housing 12, or processor 28 may execute instructions stored in a memory 24 external to housing 12 of detonation control system 10. Moreover, detonation control system 10 may include other components not specifically cited above. For example, detonation control system 10 may include a radio receiver or a port, such as a universal serial bus (USB) port, for communicating with other devices, either wirelessly or through external cabling. As used in this document, "each" refers to each member of a set or each member of a subset of a set.

Figure 3:
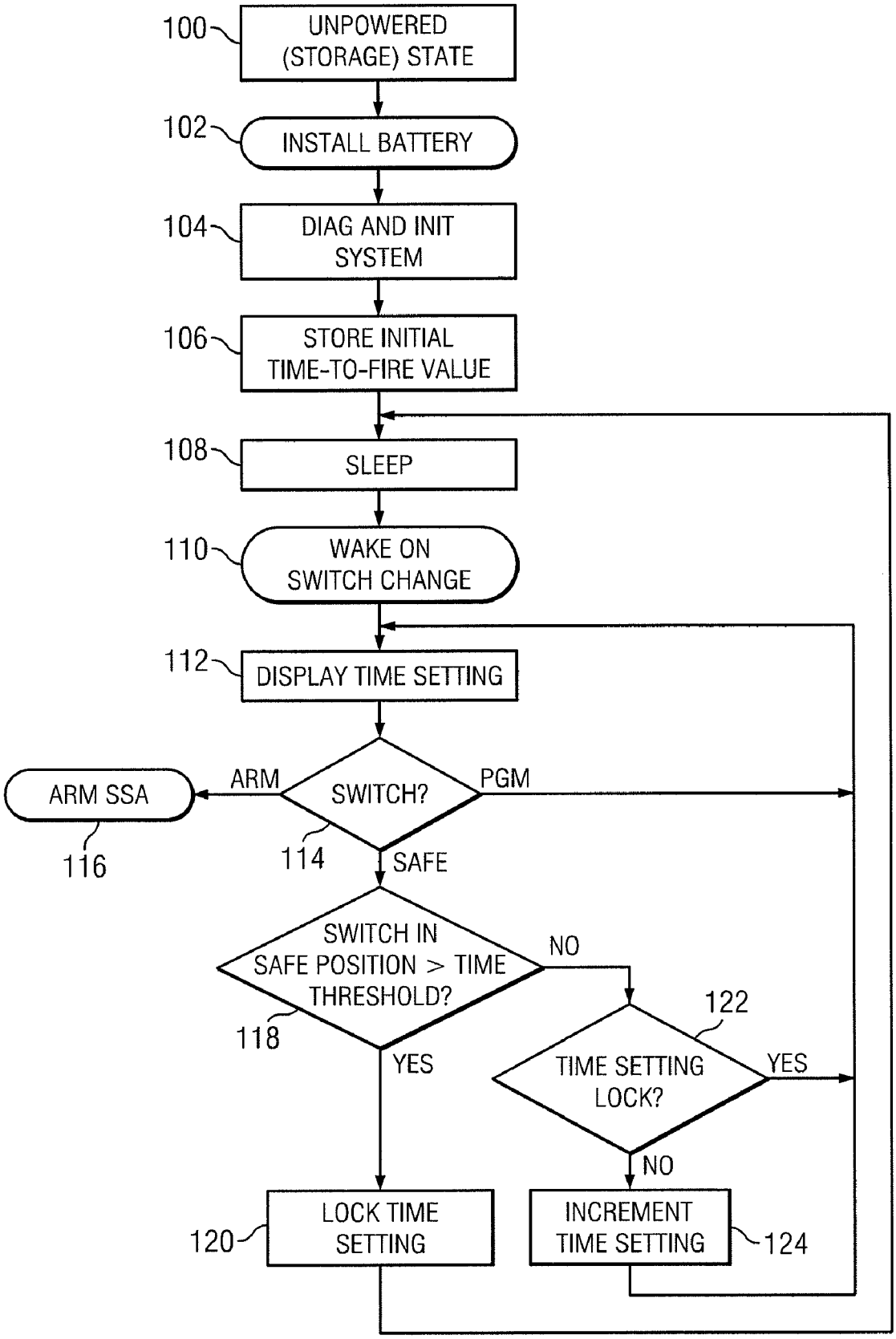
FIG. 3 illustrates an example method that may be used by certain embodiments of the present disclosure.

FIG. 3 illustrates an example method that may be used by certain embodiments of the present disclosure. In act 100, the process is initiated. In this particular state, manual switch 14 is in the safe position such that detonation control system 10 is in a storage mode in which activation of detonation device 18 is inhibited.

In act 102, a battery 26 or other suitable source of electrical power is inserted into housing 12 of detonation control system 10.

In act 104, controller 24 performs a diagnostic check upon insertion of battery 26 as described with reference to act 102. The diagnostic check may include testing the operability of various elements of detonation control system 10, such as performing a battery condition test. In certain embodiments, results of the diagnostic check may be displayed on indicator light 16. For example, an all test passed condition may be displayed by a particular sequenced illumination of indicator light 16, and a failure condition may be displayed by a differing illumination pattern of indicator light 16.

In act 106, controller 24 stores an initial elapsed delay time value in time-to-fire setting 22. In certain embodiments, a two minute elapsed delay time value may be stored in time-to-fire setting 22.

In act 108, controller 24 powers down into a sleep mode of operation.

In act 110, controller 24 wakes up from its sleep mode of operation due to movement of manual switch 14 from the safe position to the program position. In certain embodiments, controller 24 may wake up from the sleep mode using any suitable movement or combination of movements of manual switch 14. For example, manual switch 14 may include one or more momentary switches in which controller 24 wakes from its sleep mode of operation due to simultaneous activation of two or more momentary switches.

In act 112, controller 24 displays the current time-to-fire setting 22 on indicator light 16 and monitors manual switch 14 for any subsequent position movements.

Controller 24 displays, using the indicator light, an indication representing the time-to-fire setting 22 stored in memory 24. In certain embodiments, indicator light 16 includes a multi-segment light bar having multiple light emitting diodes arranged in a 1×n configuration in which each light emitting diode may be individually controlled by controller 24. Thus, controller 24 may illuminate a quantity of light emitting diodes corresponding to the current elapsed delay time value stored in time-to-fire setting 22. For the example described above in which five elapsed time values ranging from two to ten minutes may be stored in time-to-fire setting 22, indicator light 16 may include five light emitting diodes in which one light emitting diode is illuminated when a two minute value is stored in time-to-fire setting 22, two light emitting diodes are illuminated when a four minute value is stored in time-to-fire setting 22, and so on.

In act 114, detonation control system 10 may be armed by movement of manual switch 14 to the arm position, or time-to-fire setting 22 may be modified. If manual switch 14 is moved to the armed position while interlock tab 15 is actuated, processing continues in act 116 in which detonation device 18 is actuated after an elapsed delay time represented by the value stored in time-to-fire setting 22. If, however, manual switch 14 is moved to the safe position, processing continues at act 118.

In act 118, controller 24 monitors the amount of time that manual switch 14 remains in the safe position. If manual switch 14 remains in the safe position for greater than a specified amount of time, which may be, for example, 10 seconds, processing continues at act 120; otherwise processing continues at act 122.

In act 120, controller 24 locks the current time-to-fire setting 22 in memory 30 and displays the current time setting 22 on indicator light 16. Once locked, time-to-fire setting 22 may be inhibited from further modification through manual switch 14. From this point, processing continues again at act 108 in which controller 24 resumes the sleep mode of operation.

In act 122, controller 24 determines if time-to-fire setting 22 has been locked in act 120. If time-to-fire setting 22 is locked, processing continues at act 112; otherwise processing continues at act 124.

In act 124, controller 24 modifies the elapsed delay time value store in time-to-fire setting 22. That is, controller 24 stores another of the multiple time-to-fire settings in memory unit 30 upon a cyclic movement of manual switch 14. In certain embodiments, cyclic movement of manual switch 14 may include movement from the program position to the safe position, and back again to the program position. For the particular embodiment described above in which time-to-fire setting 22 has five possible values that range from two minutes to ten minutes, the existing time-to-fire setting 22 will be incremented with the next increasing time-to-fire setting 22 value. For example, if the existing time-to-fire setting 22 is two minutes, a four minute value will be stored in time-to-fire setting 22 upon the next cyclic movement of manual switch 14.

If a cyclic movement of manual switch 14 is performed a quantity of times equal to the quantity of possible time-to-fire settings, the first time-to-fire setting 22 may again be stored in memory unit 30. For example, if the existing time-to-fire setting 22 is ten minutes, a two minute time-to-fire setting 22 value will be stored in time-to-fire setting 22 upon the next cyclic movement of manual switch 14.

The previously described process continues until detonation device 18 is armed in act 116. During act 116, controller 24 will monitor the elapsed delay time that detonation control system 10 exist in the armed state and actuate detonation device 18 when the elapsed time is equal to or exceeds the time-to-fire setting 22 stored in memory unit 30. When the elapsed delay time specified in time-to-fire setting 22 has elapsed, detonation device 18 will be activated to detonate explosive 20 in which the process ends.

In certain embodiments, indicator light 16 will continually illuminate the current value of time-to-fire setting 22 for the first two minutes of countdown, and after that, will turn off. In this manner, energy usage from battery 26 may be reduced. Additionally, adversaries may not be alerted to the presence of detonation control system 10 that may otherwise be provided by illumination of indicator light 16.

Modifications, additions, or omissions may be made to the method without departing from the scope of the disclosure. The method may include more, fewer, or other acts. For example, detonation control system 10 may include other programming features that are common to detonation control systems of this type. Additionally, cyclic movement of other types of manual switches may be implemented. For example, a manual switch 14 comprising one or more momentary switches may be implemented in which cyclic movement includes pressing and releasing of at least one momentary switch at intervals within the specified time limit specified in act 118.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. A detonation control system comprising:

a controller circuit coupled to a manual switch and a detonation device, the detonation device configured to activate an explosive, the controller circuit comprising a memory operable to store one of a plurality of time-to-fire settings representing a time delay from arming the detonation device to activation of the detonation device, the controller circuit operable to a) store a first time-to-fire setting in the memory, b) store another of the plurality of time-to-fire settings in the memory upon actuation of the manual switch, and c) repeat step b) for each actuation of the manual switch;

wherein the manual switch comprises a multi-position switch having a first position and a second position, the controller operable to store the another of the plurality of the time-to-fire settings upon each actuation of the multi-position switch from the first position to the second position and back to the first position within an elapsed period of time that is less than a specified threshold.

2. The detonation control system of claim 1, wherein the multi-position switch comprises a rotary switch.

3. A detonation control system comprising:

a controller circuit coupled to a manual switch and a detonation device, the detonation device configured to activate an explosive, the controller circuit comprising a memory operable to store one of a plurality of time-to-fire settings representing a time delay from arming the detonation device to activation of the detonation device, the controller circuit operable to a) store a first time-to-fire setting in the memory, b) store another of the plurality of time-to-fire settings in the memory upon actuation of the manual switch, and c) repeat step b) for each actuation of the manual switch;

wherein the plurality of the time-to-fire settings comprises a specified quantity of time-to-fire settings, the controller circuit operable to, when performing step c), once the actuation has been performed a quantity of times equal to the specified quantity of time-to-fire settings, re-store the first time-to-fire setting in the memory.

4. The detonation control system of claim 1, wherein the plurality of time-to-fire settings comprise five time-to-fire settings that range from two minutes to ten minutes.

5. The detonation control system of claim 1, further comprising an indicator light coupled to the controller circuit, the controller circuit operable to display, using the indicator light, an indication representing the time-to-fire setting stored in the memory.

6. The detonation control system of claim 5, wherein the indicator light comprises a multi-segment light bar having multiple light emitting diodes (LEDs) arranged in a 1×n configuration, where n is a number equal to a specified quantity of time-to-fire settings.

7. The detonation control system of claim 5, wherein the controller is operable to turn off the indicator light after a second specified time period.

8. The detonation control system of claim 1, further comprising a housing that houses the controller, the detonation device, and the manual switch, the housing adapted to be placed adjacent to the explosive.

9. A detonation control system comprising:

a housing;

a detonation device and configured to activate an explosive;

a manual switch; and a controller circuit coupled to a manual switch and a detonation device, the detonation device configured to activate an explosive, the controller circuit comprising a memory operable to store one of a plurality of time-to-fire settings representing a time delay from arming the detonation device to activation of the detonation device, the controller circuit operable to a) store a first time-to-fire setting in the memory, b) store another of the plurality of time-to-fire settings in the memory upon actuation of the manual switch, and c) repeat step b) for each actuation of the manual switch;

wherein the manual switch comprises a multi-position switch having a first position and a second position, the controller operable to store the another of the plurality of the time-to-fire settings upon each actuation of the multi-position switch from the first position to the second position and back to the first position within an elapsed period of time that is less than a specified threshold.

10. The detonation control system of claim 9, wherein the multi-position switch comprises a rotary switch.

11. A detonation control system comprising:

a housing;

a detonation device and configured to activate an explosive;

a manual switch; and a controller circuit coupled to a manual switch and a detonation device, the detonation device configured to activate an explosive, the controller circuit comprising a memory operable to store one of a plurality of time-to-fire settings representing a time delay from arming the detonation device to activation of the detonation device, the controller circuit operable to a) store a first time-to-fire setting in the memory, b) store another of the plurality of time-to-fire settings in the memory upon actuation of the manual switch, and c) repeat step b) for each actuation of the manual switch;

wherein the plurality of the time-to-fire settings comprises a specified quantity of time-to-fire settings, the controller circuit operable to, when performing step c), once the actuation has been performed a quantity of times equal to the specified quantity of time-to-fire settings, re-store the first time-to-fire setting in the memory.

12. The detonation control system of claim 9, wherein the plurality of time-to-fire settings comprise five time-to-fire settings that range from two minutes to ten minutes.

13. The detonation control system of claim 9, further comprising an indicator light coupled to the controller circuit, the controller circuit operable to display, using the indicator light, an indication representing the time-to-fire setting stored in the memory.

14. The detonation control system of claim 13, wherein the indicator light comprises a multi-segment light bar having multiple light emitting diodes (LEDs) arranged in a 1×n configuration, where n is a number equal to a specified quantity of time-to-fire settings.

15. The detonation control system of claim 13, wherein the controller is operable to turn off the indicator light after a second specified time period.

16. A method comprising:

storing a first of a plurality of time-to-fire settings in a memory, each of the plurality of time-to fire settings representing a time delay from arming a detonation device to activation of the detonation device, the detonation device configured to activate an explosive;

storing another of the plurality of time-to-fire settings in the memory upon actuation of the manual switch; and repeating the step of storing another of the plurality of time-to-fire settings for each actuation of the manual switch;

wherein storing the another of the plurality of the time-to-fire settings comprises storing the another of the plurality of time-to-fire settings upon each actuation of a multi-position switch from a first position of the multi-position switch to a second position of the multi-position switch and back to the first position within an elapsed period of time that is less than a specified threshold.

17. The method of claim 16, wherein the multi-position switch comprises a rotary switch.

18. A method comprising:

storing a first of a plurality of time-to-fire settings in a memory, each of the plurality of time-to fire settings representing a time delay from arming a detonation device to activation of the detonation device, the detonation device configured to activate an explosive;

storing another of the plurality of time-to-fire settings in the memory upon actuation of the manual switch; and repeating the step of storing another of the plurality of time-to-fire settings for each actuation of the manual switch;

wherein the plurality of time-to-fire settings comprises a specified quantity of time-to-fire settings and repeating the step of storing the another of the plurality of the time-to-fire settings comprises re-storing the first time-to-fire setting in the memory once the actuation has been performed a quantity of times equal to the specified quantity of time-to-fire settings.

19. The method of claim 16, wherein the plurality of time-to-fire settings comprise five time-to-fire settings that range from two minutes to ten minutes.

20. The method of claim 16, further comprising displaying, using an indicator light coupled to the controller circuit, an indication representative of the time-to-fire setting stored in the memory.

21. The method of claim 20, wherein the indicator light comprises a multi-segment light bar having multiple light emitting diodes arranged in a 1×n configuration, where n is a number equal to a specified quantity of time-to-fire settings.

22. The method of claim 20, wherein the controller is operable to turn off the indicator light after a second specified time period.

23. The method of claim 16, further comprising housing the controller, the detonation device, and the manual switch in a housing; and placing the housing adjacent to the explosive.

24. The detonation control system of claim 9, wherein the detonation device includes an explosive charge that detonates upon an electrical signal from the controller circuit to generate an explosion that activates the explosive.

25. The detonation control system of claim 9, wherein the multi-position switch has at least one additional position in addition to the first position and the second position, the at least one additional position operable perform at least one of arming the detonation control system or placing the detonation control system in a safe mode in which the detonation control system is inhibited from activating the explosive.

* * * * *